US008720954B2

(12) United States Patent
Puusaag et al.

(10) Patent No.: US 8,720,954 B2
(45) Date of Patent: May 13, 2014

(54) ADAPTOR FOR HANDAPPLICATOR

(75) Inventors: Jaan Puusaag, Tallinn (EE); Raivo Raba, Tallinn (EE); Taavi Lauringson, Tallinn (EE)

(73) Assignee: Ou Krimelte, Tallinn (EE)

( * ) Notice: Subject to any disclaimer, the term of this patent is extended or adjusted under 35 U.S.C. 154(b) by 165 days.

(21) Appl. No.: 12/225,790

(22) PCT Filed: Oct. 25, 2006

(86) PCT No.: PCT/EE2006/000007

§ 371 (c)(1),
(2), (4) Date: Mar. 1, 2009

(87) PCT Pub. No.: WO2007/112758

PCT Pub. Date: Oct. 11, 2007

(65) Prior Publication Data

US 2009/0174183 A1 Jul. 9, 2009

(30) Foreign Application Priority Data

Mar. 31, 2006 (EE) ..... 200600011

(51) Int. Cl.
*F16L 25/00* (2006.01)

(52) U.S. Cl.
USPC ..... 285/331; 285/332.1

(58) Field of Classification Search
USPC ..... 285/330–332, 332.1, 921
See application file for complete search history.

(56) References Cited

U.S. PATENT DOCUMENTS

| | | | | | |
|---|---|---|---|---|---|
| 2,582,262 | A | * | 1/1952 | Loven et al. | 251/303 |
| 2,766,913 | A | * | 10/1956 | Wilshusen | 222/402.22 |
| 3,450,316 | A | * | 6/1969 | Barker | 222/402.22 |
| 3,588,149 | A | * | 6/1971 | Demler | 285/110 |
| 3,907,012 | A | | 9/1975 | Burke | |
| 4,076,285 | A | * | 2/1978 | Martinez | 285/332 |
| 4,150,673 | A | * | 4/1979 | Watt | 604/408 |
| 4,165,825 | A | | 8/1979 | Hansen | |
| 4,369,781 | A | * | 1/1983 | Gilson et al. | 604/403 |
| 4,477,109 | A | * | 10/1984 | Kleuver | 285/361 |
| 4,673,200 | A | * | 6/1987 | Miyauchi | 285/319 |
| 4,679,827 | A | * | 7/1987 | Law | 285/921 |
| 4,819,972 | A | * | 4/1989 | Champa et al. | 285/331 |
| 4,946,204 | A | * | 8/1990 | Boticki | 285/921 |
| 4,991,882 | A | * | 2/1991 | Gahwiler | 285/331 |
| 5,029,904 | A | * | 7/1991 | Hunt | 285/24 |
| 5,040,705 | A | * | 8/1991 | Snell | 222/402.15 |
| 5,113,900 | A | * | 5/1992 | Gilbert | 285/921 |

(Continued)

FOREIGN PATENT DOCUMENTS

| | | |
|---|---|---|
| EP | 0 816 254 A1 | 1/1998 |
| GB | 2 162 901 A | 2/1986 |

(Continued)

*Primary Examiner* — Aaron Dunwoody
(74) *Attorney, Agent, or Firm* — Birch, Stewart, Kolasch & Birch, LLP

(57) ABSTRACT

A fastening device for a hand-held applicator of foam cylinders enables the use of foam cylinders with hand applicators that were intended for applicator guns. A fastening device for a hand-held applicator is used, which is placed on the valve nozzle of a foam cylinder. The fastening device has a cavity on the side of the nozzle, in which there is a conical pipe. In addition grappling devices, such as cammed surfaces, on the inside wall of the cavity of the fastening device engage a border of the nozzle.

17 Claims, 4 Drawing Sheets

(56) References Cited

U.S. PATENT DOCUMENTS

| | | | | |
|---|---|---|---|---|
| 5,267,757 | A * | 12/1993 | Dal Palu | 285/148.21 |
| 5,271,537 | A | 12/1993 | Johnson et al. | |
| 5,330,235 | A * | 7/1994 | Wagner et al. | 285/81 |
| 5,636,875 | A * | 6/1997 | Wasser | 285/21.1 |
| 5,642,744 | A * | 7/1997 | O'Laughlin et al. | 134/166 R |
| 5,927,563 | A * | 7/1999 | Kellner | 222/402.22 |
| 6,318,410 | B1 * | 11/2001 | Miyajima et al. | 138/109 |
| 6,481,759 | B1 * | 11/2002 | Kawasaki et al. | 285/319 |
| 7,429,064 | B2 * | 9/2008 | Topolsek et al. | 285/151.1 |
| 7,481,463 | B2 * | 1/2009 | Ishida et al. | 285/305 |
| 7,740,288 | B2 * | 6/2010 | Mantell | 285/332.1 |
| 7,770,938 | B2 * | 8/2010 | Bauer | 285/305 |
| 7,984,931 | B2 * | 7/2011 | Kertesz et al. | 285/319 |
| 8,162,357 | B2 * | 4/2012 | Kahl | 285/332.1 |
| 2003/0184090 | A1 * | 10/2003 | Guala | 285/332 |
| 2007/0222216 | A1 * | 9/2007 | Bauer | 285/331 |

FOREIGN PATENT DOCUMENTS

| | | | |
|---|---|---|---|
| GB | 2 252 132 | A | 7/1992 |
| GB | 2 316 460 | A | 2/1998 |
| WO | WO-98/43894 | A1 | 10/1998 |
| WO | WO 2005/070787 | A2 | 8/2005 |

* cited by examiner

ADAPTOR FOR HANDAPPLICATOR

TECHNICAL FIELD

This invention relates to a fastening device for an applicator, primarily a hand-held applicator, which is fixed to the valve of a polyurethane foam cylinder, enabling to use hand-held applicators on the polyurethane foam cylinders designed for applicator guns.

BACKGROUND ART

Generally two types of foam applicators are used in current practice—applicator guns (U.S. Pat. No. 5,271,537 (JOHNSON CHARLES W) Dec. 21, 1993) and hand-held applicators.

The first type, applicator guns, is used mainly in professional construction, because an empty cylinder can be replaced with a full cylinder and the work may continue. The second type, so called hand-held applicators, is used mainly in private homes, where smaller quantities of polyurethane foam are needed. The mechanic and physical properties of the foams used with applicator guns and with hand-held applicators are generally different. The valves of the foam cylinders designed for different types of applicators are usually different as well, so that a hand-held applicator cannot be used on a polyurethane foam cylinder designed for applicator guns and vice versa.

In order to use a cylinder with a gun valve, the cylinder is attached to the ball valve of the applicator gun by using a threaded adapter that sits on the cylinder valve. The valve opens as a result of the pressure applied by the valve seat to the border of the valve pin, while the surfaces create a hermetic connection to prevent the pressurised content of the cylinder from going elsewhere than only through the ball valve into the applicator gun. The foam flow rate is controlled by the trigger of the applicator gun. The hand-held applicator is attached to the valve with a thread; the foam flow rate is controlled by tilting the hand-held applicator ( U.S. Pat. No. 4,165,825 (SOUTHERN CAN) Aug. 28, 1979).

Consequently the manufacturers of foam have to order and use in the manufacturing process foam cylinder valves With different designs; i.e., they produce foam cylinders designed for applicator guns and foam cylinders that can be used with hand-held applicator. This complicates the production process compared to a situation where production of only one type of cylinders would suffice.

Document U.S. Pat. No. 3,907,012 (VCA CORP) Sep. 23, 1975, describes a solution for a connecting piece that would enable, for example, leading pressurised gas from a cylinder into a vehicle tyre or other inflatable products. However, this solution is not usable on foam cylinders due to specific nature of polyurethane foam. Document GB 2252132 (WILLIAMS NORMAN) Jul. 29, 1992, describes a solution for a connecting piece that enables to connect different nozzles to an aerosol cylinder. However, this solution is not suitable for using hand-held foam applicators, because it does not provide an opportunity to control the liquid flow rate.

Document WO 2005/070787 (FAZEKAS GABOR ET AL) Aug. 4, 2005, describes a connecting piece for hand-held applicator that is attached onto the foam cylinder, accommodating the valve of the cylinder in its intake port after attachment of the connecting piece. The design enables sealed connection between the connecting piece and the cylinder to prevent the foam from coming into contact with air while leaving the cylinder.

Document GB 2316460 (SELLARS MICHAEL JOHN) Feb. 25, 1998, describes a fastening device for cleaning cylinders. The purpose of the fastening device or connecting piece is to enable cleaning applicators of various designs, i.e., both applicator guns and hand-held applicators can be attached to the cleaning cylinder. The connecting piece includes a threaded part, nipple and details for fixing the connecting piece onto the cylinder. The threaded part is designed to attach an applicator gun to the cleaning cylinder. The nipple enables attachment of a hand-held applicator to the cleaning cylinder. The nipple inside the threaded part is fixed to that part with three bridges. However, this design cannot be used for extracting the foam, because in the case of a hand-held applicator, for instance, the foam would be pressed out from the gaps between the applicator and the connecting piece.

DISCLOSURE OF INVENTION

The purpose of this invention is to offer a fastening device for the applicator, particularly the hand-held applicator, which would enable using both hand-held applicators and applicator guns on the same cylinder. The fastening device may be integrated with the inlet port of the hand-held applicator, or a fastening device in the form of a connecting piece may be produced for existing hand-held applicators, which would be attached to the hand-held applicator by a thread, enabling to use a hand-held applicator on a foam cylinder for applicator guns. Additionally, the objective is to offer a simple and yet properly sealed design for the fastening device. A further objective would be simplification of the foam cylinder manufacturing process to enable using only one type of valves, which would reduce the production costs. The objectives of the invention are achieved by producing a conical pipe section for the fastening device, whereby during the mounting of the fastening device on the foam cylinder valve, the pipe section would be pressed into the valve nozzle so that the conical pipe section creates a sealed connection between the fastening device and valve nozzle. Additionally, grappling devices, such as wedge-shaped joggles, are added to the lower part of the connecting piece; they would be hooked behind the valve nozzle border to prevent the fastening device from coming off the valve nozzle.

BRIEF DESCRIPTION OF DRAWINGS

The fastening device corresponding to the invention is described below with references to drawings, where.

BEST MODE FOR CARRYING OUT THE INVENTION

Figure 1:
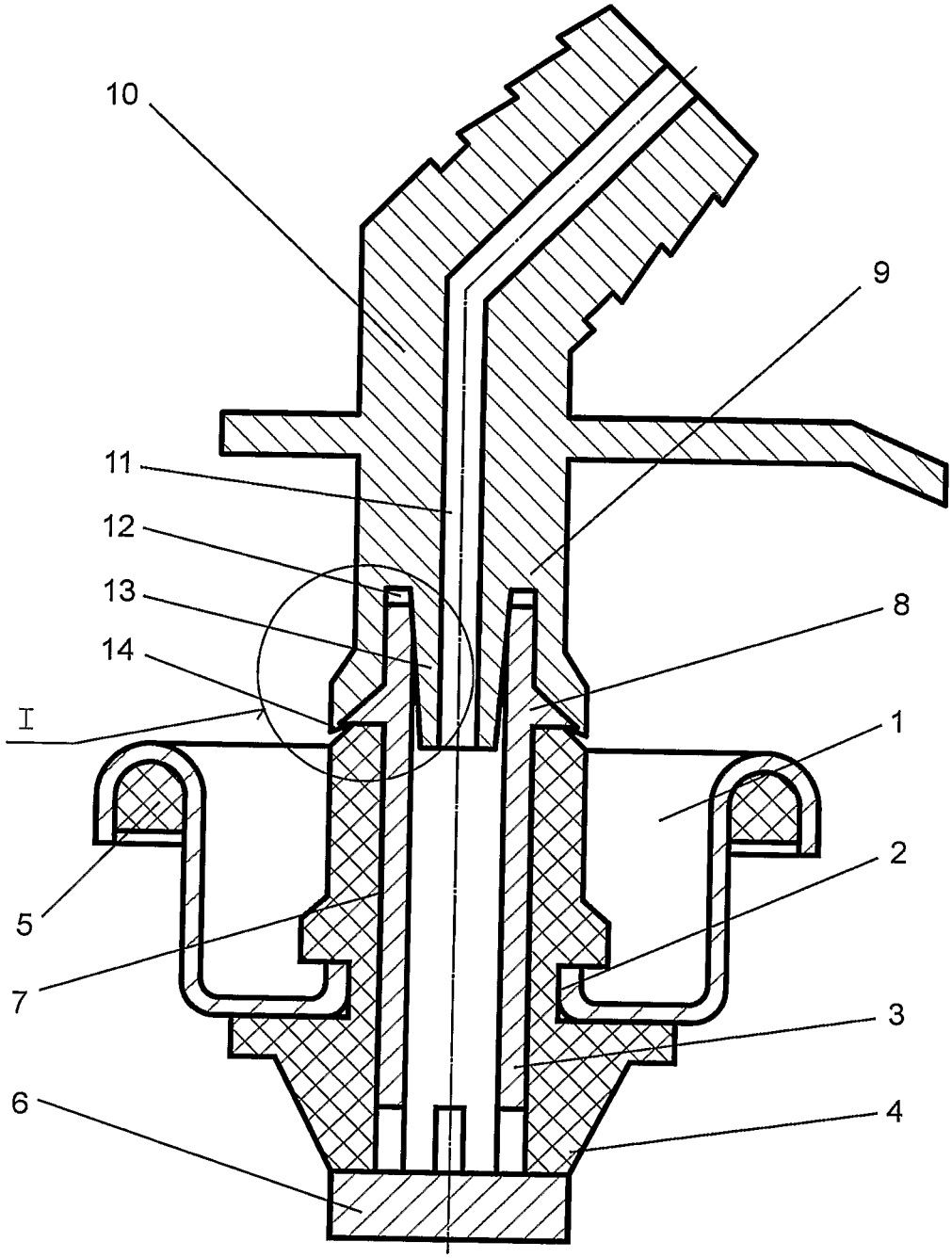
FIG. 1 shows a cross-section of the foam balloon valve cup, valve and fastening device integrated with the inlet port of the hand-held applicator.

FIG. 1 shows a valve of a foam cylinder (not showed), including a valve cup 1 with a valve nozzle 3 and gasket 4 inserted through the hole 2 in the valve cup 1. The u-shaped external flanges of the valve cup 1 include a gasket 5. The part of the valve nozzle 3 that is inside the foam cylinder has an extension 6 through which the gasket 4 supports the valve nozzle 3. The valve nozzle extends outside the cylinder through a duct 7 in the gasket 4, whereas the nozzle has outside the cylinder a border 8 supported by the gasket 4. Foam cylinder valves with this design are generally used on the cylinders for applicator guns. At the same time, the described design of the foam cylinder valve is generally known and, therefore, it will not be described further.

In order to use hand-held applicators on the foam cylinders designed for applicator guns, a fastening device integrated with a hand-held applicator 9 or a separate fastening device 19 is used. On FIG. 1, a polyurethane foam duct 11 passes through the fastening device 9 inserted in the inlet port 10 of the hand-held applicator. The lower part of the fastening device 9 has a cavity 12 and a pipe 13. The pipe 13 has a conical shape, with a diameter reducing towards the end of the pipe. Foam duct 11 passes through the pipe 13. The lower end of the fastening device 9 includes grappling devices 14, such as at least three wedge-shaped triangular cammed surfaces as shown on FIG. 3A, or four cammed surfaces, as shown in FIG. 3B, directed towards the inside of the pipe 13. The cross-section of the cammed surfaces 14 could be a square or any other configuration. The cross-section of the cammed surfaces 14 decreases in the circumferential direction and end in a radially extending edge. The combined effect of the cammed surfaces 14 and the border 8 of the valve nozzle 3 creates a 'clicking connection' when the fastening device 9 is used. The cammed surfaces 14 do not permit easy removal of the fastening device 9 from the valve nozzle and their triangular cross-section presses the fastening device 9 and conical pipe 13 tightly into the foam cylinder valve nozzle 3.

Figure 2:
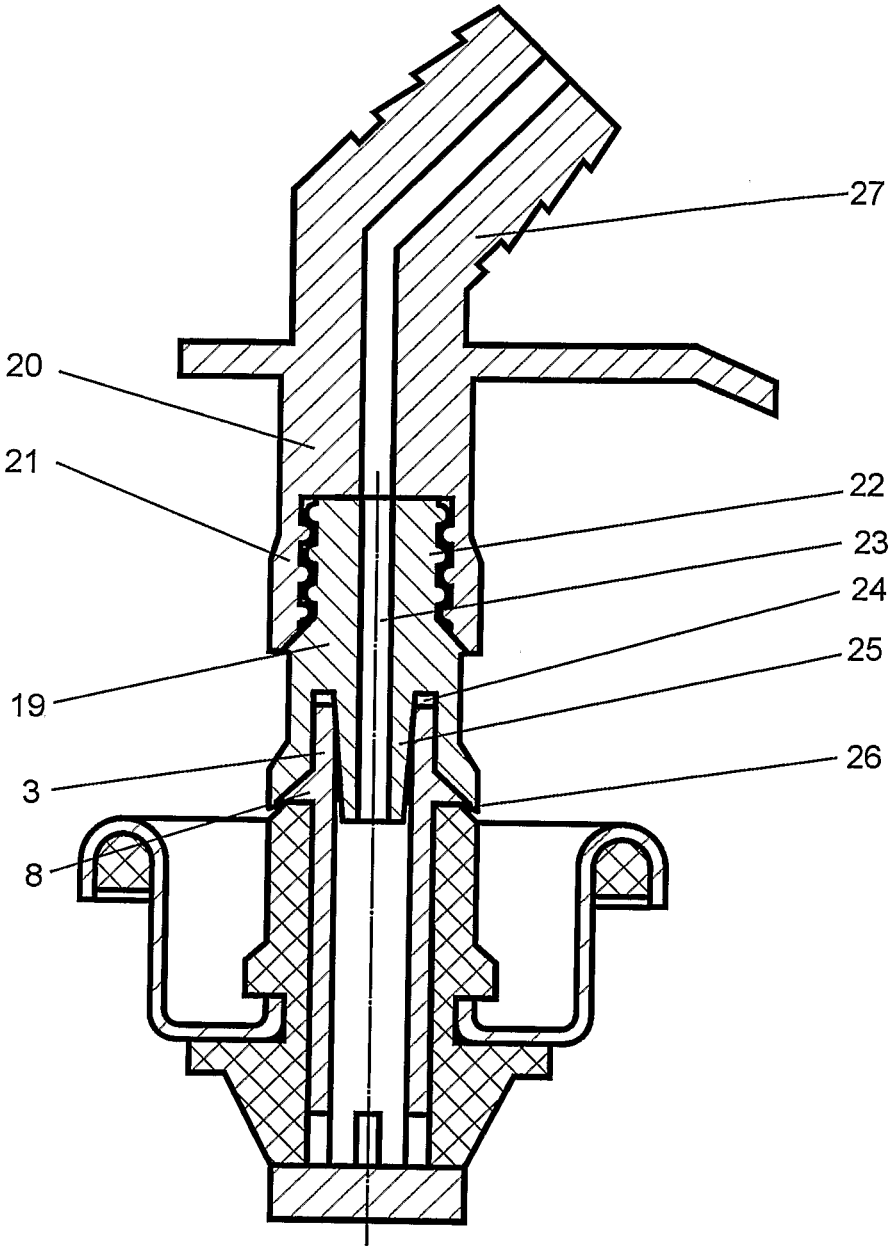
FIG. 2 shows a cross-section of the foam balloon cap, valve and fastening device attached separately to the hand-held applicator.
Figure 4:
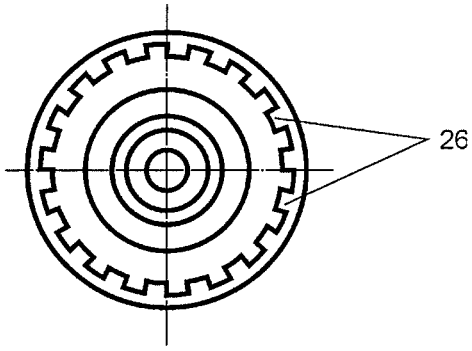
FIG. 4 shows the fastening device for a hand-held applicator as viewed from below, showing as one example for carrying out the invention the hooks.
Figure 5:
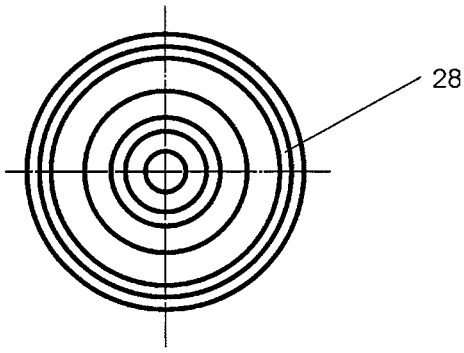
FIG. 5 shows the fastening device for a hand-held applicator as viewed from below, showing as one example for carrying out the invention the flange on the inside of the fastening device.

In an alternative version of the fastening device corresponding to this invention, the fastening device 19 is produced separately from the hand-held applicator, as displayed on FIG. 2. This solution enables to use on cylinders for applicator guns already existing hand-held applicators 27 that have an inlet port 20 with internal threading 21. They are normally used with foam cylinders produced with external threading on the valve nozzle for hand-held applicators. The upper end of the fastening device 19 covers the part with external threading 22, whereas the thread matches the internal threading of the hand-held applicator inlet port 20, 21. Polyurethane foam duct 23 passes through the fastening device 19. The lower part of the fastening device 19 has a cavity 24 and a pipe 25. The pipe 25 has a conical shape, with diameter reducing towards the end of the pipe. Foam duct 23 passes through the pipe 25. On the lower end of the fastening device are grappling devices 26, directed towards the inside of the pipe 25, such as teeth distributed evenly around the internal perimeter of the fastening device, as shown on FIG. 4. The cross-section of the teeth 26 may also be triangular or use some other configuration that ensures proper fixing of the hand-held applicator to the cylinder nozzle. When using the fastening device 19, the teeth 26 do not permit easy removal of the fastening device from the valve nozzle due to the combined effect of the teeth 26 and the border 8 of the valve nozzle, and the triangular cross-section presses the fastening device 19 and the conical pipe 25 tightly into the valve nozzle 3 of the foam cylinder.

Figure 3A:
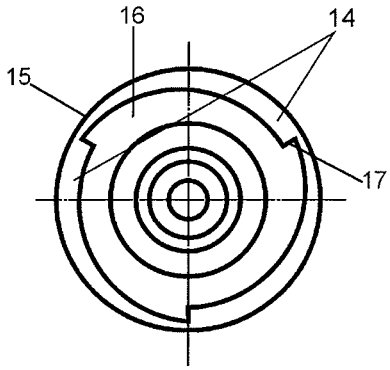
FIGS. 3*a* and 3*b* show the fastening device for a hand-held applicator as viewed from below, showing as one example for carrying out the invention the wedge-shaped joggles, three and four joggles respectively.
Figure 3B:
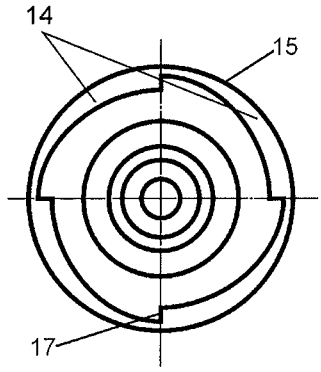
Figure 6:
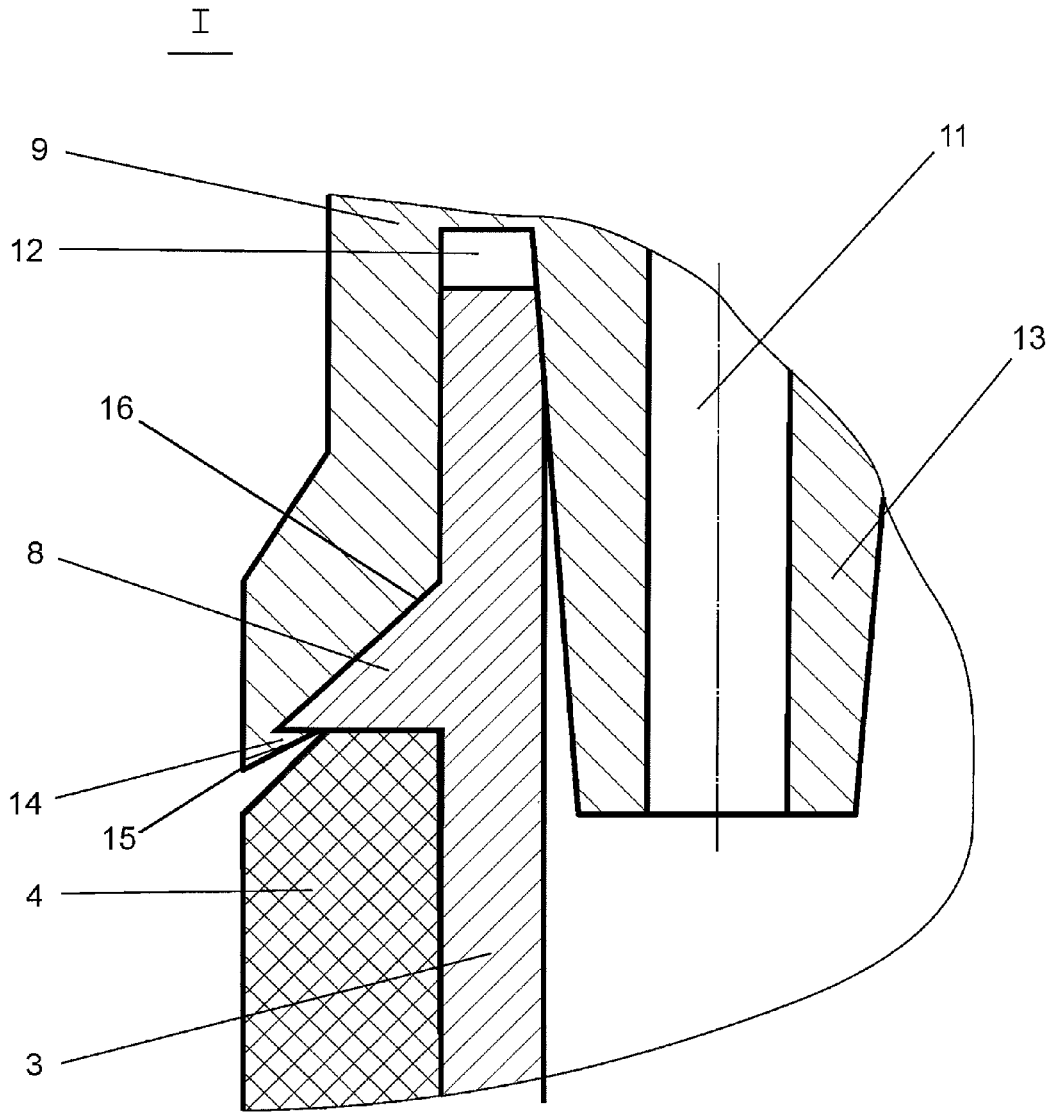
FIG. 6 shows the highlighted elements of the fastening device for a hand-held applicator from FIG. 1.

FIGS. 3*a* and 3*b* show the grappling device for a hand-held applicator as viewed from below. Form this view, the bottom surface of the grappling device is seen. The view depicts the joggles 14 as they extend about the circumference of the bottom surface 16 of the applicator. The grappling device forms an annular ring extending inwardly from the surface of the applicator. The grappling device extends in a plane perpendicular to a longitudinal axis of the duct 9. FIG. 3*a* depicts three joggles, and FIG. 3*b* depicts four joggles extending inwardly from the edge 15 where the bottom surface 16 meets the outer circumferential surface 18 of the hand-held applicator. The extent that the joggles 14 extend radially inwardly from the edge 15 varies in the circumferential direction, creating a step surface 17 between the joggles. Therefore, the radial extent of the bottom surface of the joggles 14 varies when moving in the circumferential direction. In an alternative version of the fastening device corresponding to the invention, no gaps are required between the hooks or spigots 26, so that a flange 27 (shown in FIG. 4) is formed on the lower end of the fastening device 9, 19. When the fastening device is mounted on the valve nozzle, it would grip the border 8 of the valve nozzle 3 around the entire perimeter. As can be seen in FIG. 6, the joggles have a taper in the direction of the longitudinal axis. In other words the vertical cross-section of joggle has a triangular shape.

It is clear that in a future alternative version of the invention, the duct passing through the valve nozzle 3 may be manufactured in a conical shape, with diameter decreasing towards the extension 6 of the valve nozzle 3. In this case, the pipe in the fastening device 9 of the hand-held applicator inlet port 10 does not have to be conical.

The use of the described fastening device enables the selling of foam balloons designed for applicator guns also for use with hand-held applicators. The user would connect the hand-held applicator, which has the corresponding fastening device, with the valve nozzle 3 of the foam cylinder. The manufacturer of foam cylinders would no longer face the problem with different cylinder caps. All cylinders would have the same type of valve and the user can use either an applicator gun or a hand-held applicator on the same cylinder.

Specialists in the field would understand that the design of the fastening device corresponding to this invention is not restricted to the above examples for carrying out the invention, or the appended drawings, but the design of the fastening device may be modified in compliance with the specifications protected by the appended patent claims.

The invention claimed is:

1. A fastening device for a hand-held applicator, comprising:

a body having an outer sidewall, an inner sidewall, and a bottom surface extending radially and having an outer edge connected to the outer sidewall and an inner edge connected to the inner sidewall;

a duct extending through the body;

a cavity formed in a bottom of the body;

a pipe integrally formed with the body and protruding from a surface of the body within the cavity, the pipe communicating with the duct; and a grappling device formed in the bottom surface of the body, the grappling device comprising an annular ring extending radially inwardly from the bottom surface of the body in a plane perpendicular to a longitudinal axis of the duct, a radial extent of the grappling device varying about the circumference of the grappling device, wherein the annular ring does not extend radially inwardly past the body inner sidewall.

2. The fastening device of claim 1, wherein an inwardly extending surface of the annular ring is a toothed surface.

3. The fastening device of claim 1, wherein the bottom surface tapers outwardly from the inner sidewall to the outer sidewall.

4. The fastening device of claim 1, wherein the annular ring comprises a plurality of protrusions, each protrusion having a triangular cross section in the plane perpendicular to the longitudinal axis of the duct.

5. The fastening device of claim 4, wherein each protrusion includes a first surface extending radially from the bottom surface of the body and a second surface extending radially and circumferentially from the bottom surface of the body to the first surface.

6. A foam applicator, comprising:

a valve nozzle having an outwardly extending flange, the flange having an outer edge; and a fastening device for a hand-held applicator, the fastening device including a body having an outer sidewall, an inner sidewall, and a bottom surface extending radially and having an outer edge connected to the outer sidewall and an inner edge connected to the inner sidewall, a duct extending through the body, a cavity formed in a bottom of the body, a pipe integrally formed with the body and protruding from a surface of the body within the cavity, the pipe communicating with the duct, the pipe creating a sealed connection between the fastening device and the valve nozzle, and a grappling device formed in the bottom surface of the body, the grappling device comprising an annular ring extending radially inwardly from the bottom surface of the body in a plane perpendicular to a longitudinal axis of the duct, a radial extent of the grappling device varying in a circumferential direction, wherein the annular ring does not extend radially inwardly past the body inner sidewall, and wherein the grappling device engages the outer edge of the valve nozzle flange.

7. The foam applicator of claim 6, wherein an inwardly extending surface of the annular ring is a toothed surface.

8. The foam applicator of claim 6, wherein an inner diameter of the cavity is the same as the outer diameter of the valve nozzle.

9. The foam applicator of claim 6, wherein the bottom surface tapers outwardly from the inner sidewall to the outer sidewall.

10. The foam applicator of claim 2, wherein the grappling device is integrally formed with the inner sidewall.

11. The foam applicator of claim 6, wherein the annular ring comprises a plurality of protrusions, each protrusion having a triangular cross section in the plane perpendicular to the longitudinal axis of the duct.

12. The foam applicator of claim 11, wherein each protrusion includes a first surface extending radially from the bottom surface of the body and a second surface extending radially and circumferentially from the bottom surface of the body to the first surface.

13. A fastening device for a hand-held applicator, comprising:

a body having an inner surface, an outer surface and a bottom surface extending between the inner and outer surface;

a duct extending through the body;

a pipe integrally formed, the pipe spaced radially inwardly from the body inner surface to form a cavity, the pipe communicating with the duct; and a grappling device integrally formed with the bottom surface of the body, the grappling device comprising an annular ring extending radially inwardly from the bottom surface of the body in a plane perpendicular to a longitudinal axis of the duct, wherein the annular ring does not extend radially inwardly past the body inner surface, and wherein the bottom surface tapers outwardly from the body inner surface to the body outer surface.

14. The fastening device of claim 13, wherein a radial extent of an radially inwardly extending surface of the annular ring varies in a circumferential direction.

15. The fastening device of claim 13, wherein the grappling device is integrally formed with the inner sidewall.

16. The fastening device of claim 12, wherein the annular ring comprises a plurality of protrusions, each protrusion having a triangular cross section in the plane perpendicular to the longitudinal axis of the duct.

17. The fastening device of claim 16, wherein each protrusion includes a first surface extending radially from the bottom surface of the body and a second surface extending radially and circumferentially from the bottom surface of the body to the first surface.

* * * * *